US009796525B2

(12) United States Patent
Orgeldinger

(10) Patent No.: US 9,796,525 B2
(45) Date of Patent: Oct. 24, 2017

(54) BOX

(71) Applicant: IFCO Systems GmbH, Pullach (DE)

(72) Inventor: Wolfgang Orgeldinger, Pullach (DE)

(73) Assignee: IFCO Systems GmbH, Pullach (DE)

( * ) Notice: Subject to any disclaimer, the term of this patent is extended or adjusted under 35 U.S.C. 154(b) by 0 days.

(21) Appl. No.: 13/962,810

(22) Filed: Aug. 8, 2013

(65) Prior Publication Data

US 2013/0320007 A1 Dec. 5, 2013

Related U.S. Application Data

(63) Continuation of application No. PCT/EP2011/051946, filed on Feb. 10, 2011.

(51) Int. Cl.

| | |
|---|---|
| ***B65D 8/14*** | (2006.01) |
| ***B65D 88/52*** | (2006.01) |
| ***B65D 6/18*** | (2006.01) |

(52) U.S. Cl.

CPC ..... *B65D 88/524* (2013.01); *B65D 11/1833* (2013.01)

(58) Field of Classification Search

CPC .. B65D 11/1833; B65D 88/524; A01M 23/30; A01M 23/24; A61B 17/1277; A61M 16/0683

USPC ..... 220/7, 6, 4.34, 4.33, 4.28, 682, 691; 267/73, 149

See application file for complete search history.

(56) References Cited

U.S. PATENT DOCUMENTS

| | | | | |
|---|---|---|---|---|
| 1,215,292 | A * | 2/1917 | McKay | 220/7 |
| 1,462,102 | A * | 7/1923 | Dodson | 43/82 |
| 7,011,225 | B2 * | 3/2006 | Oster et al. | 220/7 |
| 7,195,128 | B2 | 3/2007 | Murakami et al. | |
| 2003/0000950 | A1 * | 1/2003 | Murakami et al. | 220/6 |
| 2003/0146213 | A1 | 8/2003 | Kellerer et al. | |
| 2004/0129700 | A1 | 7/2004 | Oster et al. | |
| 2007/0145053 | A1 | 6/2007 | Escarpa Gil | |

(Continued)

FOREIGN PATENT DOCUMENTS

| | | |
|---|---|---|
| EP | 1544116 | 6/2005 |
| EP | 2036825 | 3/2009 |
| JP | 2003040263 A | 2/2003 |

(Continued)

OTHER PUBLICATIONS

English translation of JP2009023669 from ESPACENET Dec. 13, 2015.*

*Primary Examiner* — Anthony Stashick
*Assistant Examiner* — James M Van Buskirk
(74) *Attorney, Agent, or Firm* — Michael A. Glenn; Perkins Coie LLP

(57) ABSTRACT

A box includes a floor and at least two pairs of opposing sidewalls extending upwards from the floor in the vertical direction. The sidewalls are arranged foldably with respect to the floor and may be locked with each other in their upfolded position. At least one of the sidewalls includes an unlocking mechanism which is movable between a rest position and an unlocking position in which the locking of the sidewalls is undone. The unlocking mechanism includes at least one pretensioning element which pretensions the unlocking mechanism into its rest position and includes a first end connected to the unlocking mechanism or the sidewall and a second, free end.

8 Claims, 3 Drawing Sheets

(56) References Cited

U.S. PATENT DOCUMENTS

2010/0294757 A1* 11/2010 Pils ..... 220/7

FOREIGN PATENT DOCUMENTS

| | | | |
|---|---|---|---|
| JP | 2004131138 | A | 4/2004 |
| JP | 2009023669 | A | 2/2009 |
| WO | WO-2010119073 | | 11/2010 |

* cited by examiner

BOX

CROSS-REFERENCE TO RELATED APPLICATIONS

This application is a continuation of copending International Application No. PCT/EP2011/051946, filed Feb. 10, 2011, which is incorporated herein by reference in its entirety.

BACKGROUND OF THE INVENTION

The present invention relates to a box for transporting goods, in particular to a foldable box and here to a pretensioning mechanism for an unlocking mechanism.

In the known technology, boxes for transporting goods are known, wherein such boxes are implemented foldably in order to define a small volume in a down-folded state so that a plurality of non-used empty boxes may be transported together on a pallet, wherein the number of the boxes transported together in the down-folded state is substantially higher than the possible number of boxes which may not be folded or boxes which are in an up-folded state. Such boxes are, for example, used for the transport of vegetables or fruit but also for the transport of other goods from a manufacturer to a buyer, wherein after their arrival at the buyer, the boxes are either used for the presentation of the goods in sales rooms or are emptied. As soon as the goods have been removed from the boxes, for example by selling the same, the boxes are used again.

During transport from the manufacturer to the buyer, the boxes are in the up-folded state and contain goods, for example fruit or vegetables, and when returning the same the boxes are down-folded in order to reduce the volume of same and thus, as mentioned above, be able to transport a large number of boxes at the same time.

FIG. 1 shows a schematic illustration of such a known box. The box includes a floor 10 and four side walls 12, 14, 16, 18. One pair of sidewalls is opposite to each other and as illustrated in FIG. 1 the box includes two short sidewalls 12 and 14 which are opposite to each other and two long sidewalls 16 and 18 which are opposite to each other. The dimensions of the short and long sidewalls are generally selected depending on the transport pallets, wherein several such boxes are arranged in one layer. In the European area for example three such boxes are arranged adjacent to each other with their long sides and on one of the short sides of the series of arranged boxes, two boxes are arranged in a transverse way whose short side surfaces are adjacent.

At least two opposing side walls include grip holes so that the box may be gripped and carried. In the example illustrated in FIG. 1, each of the side walls 12 to 18 includes a corresponding grip opening 20, 22, 24, 26. The side walls 12 to 18 are arranged foldably with respect to the floor 10, i.e., the side walls 12 to 18 may be folded onto the floor 10 so that the volume of the box is reduced to a minimum for their transport back. It may, for example, be provided to first fold the short side walls 12 and 14 onto the floor 10 and subsequently turn down the long side walls 16 and 18, wherein in such a case the joints for the short side walls are arranged lower than the joints for the long side walls so that e.g., the floor in the area of the long side walls 16 and 18 has a higher frame than in the area of the short side walls 12 and 14.

For bringing about the necessitated stability of the up-folded box the side walls 12 to 18 may be locked with respect to each other, wherein in the example illustrated in FIG. 1 a locking of the end surfaces 12 and 14 to the neighboring ends of the long sides 16 and 18 takes place. The short side walls 12 and 14 may comprise one or several protrusions which engage corresponding recesses in the side walls, wherein the side walls then comprise protrusions having corresponding recesses accordingly directing into the direction of the inner side of the box. In addition to these elements, a locking element is provided by means of which the side walls are locked with respect to each other in their up-folded position. In FIG. 1, corresponding locking elements are schematically designated by reference numerals 28, 30, 32 and 34 at the upper corners of the box. The locking elements 28 to 34 each include two elements, for example a fixed element provided on the protrusions of the long side walls 16 and 18, which may engage a further element provided at the short side walls 12 and 18. For locking and unlocking the corresponding element of the short side walls 12 and 14 is implemented movably, i.e., movable between a locked position in which the element engages the elements of the long side walls and an unlocked position in which no engagement of the elements takes place so that the short side walls may be folded into the direction of the interior of the box.

In order to enable a movement of the moving elements of the short sides 12 and 14, each of the short sides additionally includes an unlocking mechanism 36, wherein in FIG. 1 only the unlocking mechanism of the short side 12 is illustrated, the short side 14, however, comprises a corresponding mechanism. The unlocking mechanism 36 includes an unlocking bar 38 extending across the short side wall 12. The unlocking bar 38 includes two ends 40 and 42 at which the unlocking bar 38 is connected to the corresponding locking elements 28 and 30 of the short side 12. In the example illustrated in FIG. 1, the unlocking bar 38 extends from its first end arcuately downward in the direction of the floor 10 and then in parallel to the floor below the grip opening past the same in order to then again extend upwards in a curved manner towards the second end 42. The short side wall includes two guiding grooves 44 and 46 in which the unlocking bar 38 is guided by means of guide pins 48 and 50. In FIG. 1, the unlocking bar is illustrated in its rest position in which the unlocking bar cooperates with the locking element such that the same are in their locked position. In order to cause an unlocking of the locking elements 28 and 30, the unlocking bar is moved upwards, i.e., in a vertical direction upwards when seen from the floor, whereby the locking elements of the side wall connected to the ends 40 and 42 of the unlocking bar get out of engagement from the corresponding locking elements of the side walls 16 and 18 so that an unlocking was executed and turning down the side wall is enabled.

As a secure locking is desired in the up-folded state of the box, it is necessitated to only enable a movement of the locking bar 38 in the unlocked position when this is desired, in particular a movement into the unlocking position, for example due to a shock or impact or the like is to be prevented.

For this reason, the known box according to FIG. 1 includes the pretensioning elements 52 and 54 which extend between the unlocking bar 38 and an upper frame 56 of the side wall 12. The pretensioning elements 52 and 54 are integrally connected to the unlocking bar 38. Further, the upper ends of the pretensioning elements 52 and 54 are mounted to a bottom side of the upper frame. Between the mounting points, an inclined portion of the pretensioning elements 52 and 54 extends so that the opposing end points of the pretensioning elements are arranged spaced apart from each other in the transverse direction of the side wall, whereby the necessitated restoring force is provided with a movement of the unlocking bar 38 into its unlocking position into the direction of the rest position.

With a movement of the unlocking bar into the above mentioned unlocking position, the inclined portion between the end points of the pretensioning elements 52 and 54 is extremely stressed as the two are mounted on both sides so that it turned out with boxes implemented according to FIG. 1 that after a finite number of transport cycles which each include upfolding and downfolding the box a break of the inclined portion of the pretensioning element took place so that a secure locking of the box by holding the unlocking bar in its rest position is not guaranteed over time with such boxes.

SUMMARY

According to an embodiment, a box may have: a floor; and at least two pairs of respectively opposing sidewalls extending upwards from the floor in a vertical direction, wherein the sidewalls are arranged foldably with respect to the floor and may be locked to each other in their upfolded position, wherein at least one of the sidewalls includes an unlocking mechanism which is movable between a rest position and an unlocking position in which locking of the sidewalls is undone, wherein the unlocking mechanism includes at least one pretensioning element pretensioning the unlocking mechanism into its rest position and including a first end connected to an unlocking bar of the unlocking mechanism and a second, free end, wherein the at least one sidewall includes an upper frame, wherein the movement of the unlocking mechanism from the rest position into the unlocking position includes a movement into the direction of the upper frame, and wherein the free end of the pretensioning element is applied to a bottom side of the upper frame or to an upper side of the unlocking mechanism, both in the rest position and also in the unlocking position of the unlocking mechanism, and wherein the upper frame includes a protrusion extending downwards in an area in which the free end of the pretensioning element is applied to its bottom side, wherein the free end is arranged in the direction of the interior of the box behind the protrusion.

Embodiments of the invention provide a box having a floor and at least two pairs of respectively opposing side walls extending upwards from the floor in a vertical direction, wherein the side walls are arranged foldably with respect to the floor and may be locked with each other in their up-folded position, wherein at least one of the side walls includes an unlocking mechanism which may be moved between a rest position and an unlocking position in which the locking of the side walls is undone, wherein the unlocking mechanism includes at least one pretensioning element which pretensions or pre-loads the unlocking mechanism into its rest position and includes a first end connected to the unlocking mechanism or the side wall and a second, free end.

Embodiments of the invention provide a box having a floor, at least two pairs of opposing side walls extending upwards from the floor in the vertical direction, wherein the side walls are arranged foldably with respect to the floor, wherein the side walls may be locked to each other in their up-folded position, wherein at least one of the side walls includes an unlocking mechanism which is moveable between a rest position and an unlocking position in which the locking of the side walls is undone, wherein the unlocking mechanism includes at least one pretensioning element which is formed integrally with the unlocking mechanism and wherein an end of the pretensioning element facing away from the unlocking mechanism is free and applied to one portion of the side wall in order to pretension the unlocking mechanism into its rest position.

According to embodiments of the invention, one side wall includes a first locking element which cooperates with a second locking element of a neighboring side wall to lock the side wall and the neighboring side wall in the up-folded position, wherein the unlocking mechanism cooperates with the first locking element so that a movement of the unlocking mechanism in its unlocking position causes an unlocking of the first and second locking elements, wherein the unlocking mechanism returns into its rest position without actuation due to the pretensioning element. According to this embodiment, it may be provided for the one side wall to include an upper frame, wherein the movement of the unlocking mechanism from the rest position into the unlocking position includes a movement into the direction of the upper frame, and wherein the free end of the pretensioning element is applied to a bottom side of the upper frame both in the rest position and also in the unlocking position of the unlocking mechanism. The upper frame may include a protrusion extending upwards in an area in which the free end of the pretensioning element is applied to its bottom side, wherein the free end is arranged in the direction towards the interior of the box behind the protrusion.

Further, according to embodiments, the at least one side wall may include a wall section in which the thickness is smaller than the thickness of the upper frame and which extends from the upper frame downwards, wherein the free end of the pretensioning element is arranged between the protrusion and the wall section.

The protrusion element may have a thickness which corresponds to the thickness of the upper frame minus the thickness of the wall section, wherein the thickness of the free end of the pretensioning element is smaller than the thickness of the rest of the pretensioning element.

The thickness of the free end of the pretensioning element may basically correspond to the thickness of the upper frame minus the thickness of the wall section and minus the thickness of the protrusion.

According to embodiments of the invention, the pretensioning element is made from the same material as the unlocking mechanism, wherein the pretensioning element includes a first basically vertical section arranged at the unlocking mechanism, a second inclined section which extends between the first section and the protrusion and a third section basically vertical in the rest position of the unlocking mechanism which extends from the second portion or section to the free end of the pretensioning element.

According to further embodiments, the pretensioning element may be configured such that no pretension is exerted on to the unlocking mechanism in the rest position and that with a movement of the unlocking mechanism from the rest position in the direction of the unlocking position, an increasing tension in the direction of the rest position is caused.

According to embodiments, a side wall may comprise at least one guide opening in which a guiding element of the unlocking mechanism is arranged, wherein the guide opening defines a movement between the rest position and the unlocking position.

According to further embodiments, two opposing side walls each include one unlocking mechanism, wherein the unlocking mechanism includes one unlocking bar which extends in a transverse way across the side walls between the bolts and includes two pretensioning elements arranged symmetrically with respect to the center of the side walls.

According to the invention, a box is provided wherein the above mentioned problems of known boxes are avoided in connection with the pretensioning element, in particular a breaking of the same. This is achieved by the pretensioning element being only mounted to the unlocking mechanism, for example the unlocking bar and comprising a free end which is only applied to a bottom side of the upper frame of the side wall. This causes the pretensioning element not to be firmly clamped between the upper frame and the moveable unlocking bar any more, rather its free end facing away from the unlocking bar, with respect to a movement of the unlocking bar into the unlocking position which usually is a movement which is vertical with respect to the box floor upwards, may execute both a lateral and also a vertical movement whereby the stress onto the pretensioning element, in particular a stress onto its central section is reduced and thus a breaking of the pretensioning element is prevented even after a plurality of cycles during which locking and unlocking took place. Alternatively, one end of the pretensioning element may be mounted to the side wall or to the upper frame and the other free end is applied to the unlocking bar.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
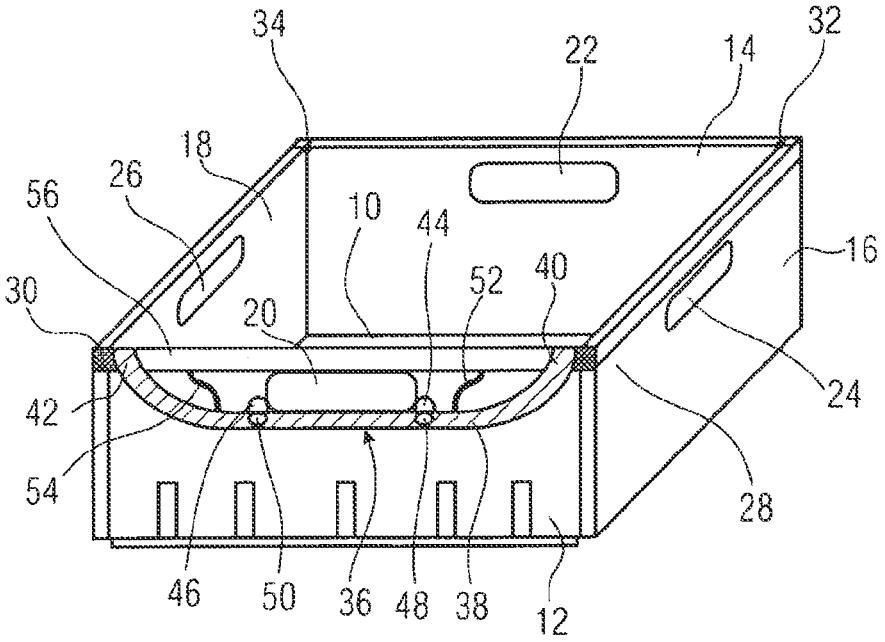
FIG. 1 shows a schematic illustration of a known box.

In the following description of the embodiments of the invention like or seemingly like elements are provided with the same reference numerals. It is further noted that those elements of the box which were already described with reference to FIG. 1 are provided with the same reference numerals in the following description of the embodiments of the invention, wherein a renewed description of the elements already described with reference to FIG. 1 is omitted.

Figure 2:
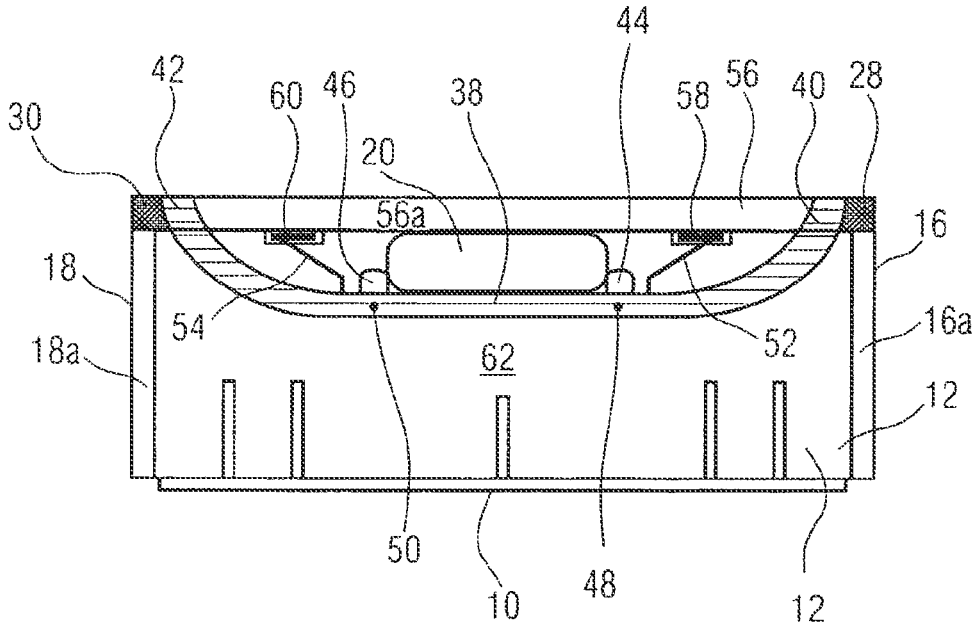
FIG. 2 shows a top view onto a side wall of a box as described, for example, with reference to FIG. 1, which includes a pretensioning mechanism according to embodiments of the invention.

FIG. 2 shows a top view onto a side wall of a box as it was, for example, described with reference to FIG. 1, which includes a pretensioning mechanism according to embodiments of the invention. The side wall illustrated in FIG. 2 may be one of the short side walls, wherein here, for example, a short side wall 12 of a box is illustrated which was described with reference to FIG. 1. It is to be noted here that the opposing short side 14 may have the same or a similar structure. Likewise, it may be provided to provide the unlocking mechanism on the long side walls 16 and 18.

In FIG. 2, next to the side wall 12, an edge 16*a* of the side wall 16 and an edge 18*a* of the side wall 18 is illustrated. The edge 18*a* includes a region which is not illustrated in more detail which overlaps an edge region or area of the short side wall 12, wherein the overlapping areas comprise recesses and protrusions which engage in order to thus cause a stable connection between the side walls in the locked state. In the upper corner area in which the side walls 12 and 16 or 12 and 18, respectively, abut locking mechanisms 28 and 30 are illustrated schematically. In the situation illustrated in FIG. 2, the elements 28 and 30 are in their locked position, i.e., turning down the side wall 12 onto the floor 10 is not possible due to the locking. FIG. 2 further shows the unlocking bar 38 and its two opposing ends 40 and 42 connected to the locking elements of the locking mechanisms 28 and 30 associated with the side wall 12. Further, the pretensioning elements 52 and 54 are illustrated schematically which extend between the unlocking bar 38 and a bottom side of the upper frame 56 of the side wall 12.

In contrast to the example described with reference to FIG. 1, however, it is provided according to embodiments of the invention for the pretensioning elements which are, for example, manufactured from the same material as the unlocking bar, to be manufactured integrally with the unlocking bar or to be firmly connected to the same (e.g., bonded, screwed, riveted or the like), wherein the ends facing the upper frame 56 are free, i.e., these ends are not firmly connected to the bottom side or to another part of the upper frame 56 or the side wall 12. The pretensioning elements 52 and 54, in the rest position of the unlocking bar 38 illustrated in FIG. 2, are also in their rest position, which means that the same are in their relaxed or unbent position, i.e., exert no pretension in the direction of the box floor 10. The pretensioning elements 52 and 54 may for example be manufactured together by a suitable plastics forming process in one work cycle or operation, for example using a common mold whereby the manufacturing of the pretensioning elements and the unlocking bar is enabled integrally.

If the unlocking bar is now moved in a direction upwards, i.e. in a direction away from the floor 10 of the box, the pretensioning elements 52 and 54 are deformed such that their central portions, the inclined portions illustrated in FIG. 2, are deformed into the direction of the box floor. The front, free ends of the pretensioning elements 52 and 54 are moved outwards along the bottom side of the upper frame 56 and simultaneously the central portions are deformed, whereby a restoring force for the unlocking element in the direction of its rest position is generated so that unlocking is only possible by overcoming the corresponding spring force or pretensioning force of the pretensioning elements for unlocking. By this, locking during transport is guaranteed, and also when the locking element is unintentionally lifted, the same returns into a locked position after the actuation of the element 38 is over.

As it may further be seen from FIG. 2, the upper frame 46 includes protrusions 58 and 60 which extend from a bottom side of the upper frame 46 in the region downwards in which the free ends of the pretensioning elements 52 and 54 are in contact with the bottom side of the upper frame 56. The sidewall 12 includes a wall section 62 which extends originating from the upper frame 56 downward in the direction of the floor 10. The wall section 62 has a thickness which is smaller than the thickness of the upper frame 56. On one side of the sidewall 12 directed into the direction of the interior of the box the wall section 62 is flush with a back surface of the upper frame 56, whereby the wall section 62 on the exterior side of the sidewall 12 returns or jumps back with respect to a front surface of the upper frame 56. The protrusions 58 and 60 extend from a front surface of the upper frame 56 downward, so that between the protrusion 58, 60 and the wall 62 a free space results in which the free end of the pretensioning elements 52 and 54 is arranged. Due to this arrangement, guiding the free end of the pretensioning elements is achieved, in particular guiding in the transverse direction of the sidewall 12, wherein in particular a movement in the direction perpendicular to the wall surface of the sidewall 12 is prevented.

Figure 3:
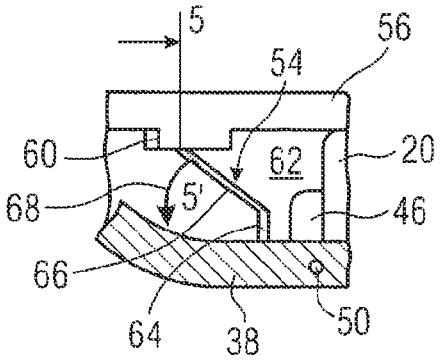
FIG. 3 shows an enlarged illustration of the left hand pretensioning element of FIG. 2.

FIG. 3 shows an enlarged illustration of a part of FIG. 2, i.e. of the left pretensioning element. It is to be noted here that also the right-hand pretensioning element 52 is implemented accordingly. The pretensioning element 54 includes a first vertical section 64 which is integral with the unlocking bar 38 or is mounted to the unlocking bar 38 adjacent to the guide pin 50. The pretensioning element 54 further includes the inclined central section 66 already mentioned above which extends from the first section 64 to the protrusion 60. The free end of the element 54 is hidden behind the protrusion 60 in FIG. 3 but is, as already mentioned, not mounted to the upper frame 56 but may move along its bottom side behind the protrusion 60 in the lateral direction, so that with an upward movement of the element 38 a corresponding movement of the section 66 of the pretensioning element 54 may take place downward along the curved arrow 68. By this, a corresponding restoring force is generated which acts upon the unlocking element 38 to force the same back into its rest position.

Figure 4:
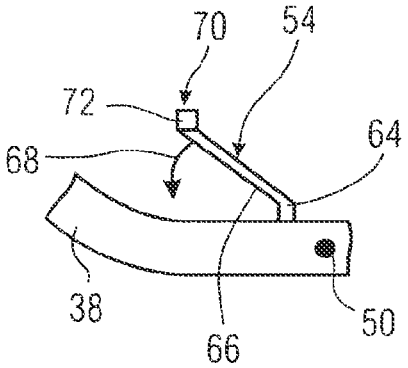
FIG. 4 shows a section of the locking mechanism without the elements of the side wall.

FIG. 4 shows a section of a locking mechanism without the elements of the sidewall 12. The locking mechanism includes the unlocking bar 38 and the pretensioning element 54. Next to the first and second section 64 and 66 now also the free end 70 of the pretensioning element 54 may be seen, wherein the pretensioning element 54 includes a third section 72 which extends originating from the second section in the rest position of the pretensioning element, in which no force is exerted onto the same, basically perpendicularly upwards up to the free end 70. The third section of the pretensioning element has a thickness, according to embodiments, which is smaller than the thickness of the first and second section of the pretensioning element 54, wherein the thickness of the first and second section of the pretensioning element may be selected so that the same corresponds to a thickness of the upper frame 56 minus the thickness of the wall section 62, so that when the unlocking mechanism is installed its front surface which is facing outward is basically flush with a front surface of the upper frame which is facing outward (see reference numeral 56*a*). In contrast to that, the thickness of the third section 72 is reduced, wherein the same is smaller according to embodiments than the thickness of the upper frame 56 minus the thickness of the wall section 62 minus the thickness of the protrusion 60.

Figure 5:
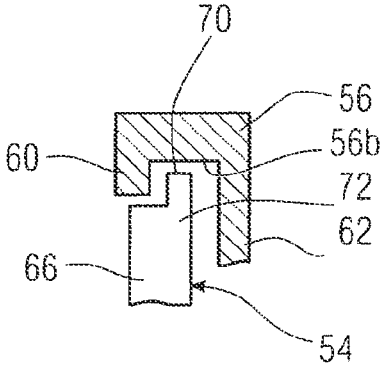
FIG. 5 shows a cross-section along line 5-5' in FIG. 3.

FIG. 5 shows a sectional view along line 5-5' in FIG. 3 and shows how the free end 70 of the pretensioning element 54 is formed in the gap formed between the protrusion 60 and the wall 62. The free end 70 is not connected to the upper frame 56 but is applied to its bottom side 56*b* and may move along this bottom side in the lateral direction.

Embodiments were described with reference to FIGS. 2-5 of the invention, wherein it is noted, however, that the present invention is not limited to the described implementation of the unlocking mechanism. Rather, also different implementations of the unlocking mechanism may be provided which operate such that a movement from a rest position into an unlocking position is provided wherein a corresponding restoring force into the rest position is necessitated which is then achieved using the inventive approach, i.e. using a pretensioning element which comprises the two ends, one end of which is either mounted to the sidewall or to the unlocking element, e.g. formed integrally with the same, and the other end is free. Further, in embodiments separate unlocking mechanisms may be provided instead of the common unlocking bar 58 which have to be operated separately in order to cause the unlocking.

Embodiments of the invention were described above with reference to a pretensioning element whose end facing the unlocking bar is formed integrally with the same. It is to be noted that the pretensioning element may be mounted to the bar 38 by suitable means (e.g. screws, bonding, riveting), instead by the integral connection. It may alternatively be provided to mount the pretensioning element to the bottom side or to another suitable position of the upper frame 56 or the sidewall 12 with one end so that its free end acts upon a surface of the unlocking bar 38, whereby a functionality of the same effect is achieved as it was explained above.

According to embodiments the box may be closed by actuating the bolt so that the corresponding wall is released for being turned down or folded down onto the box floor. Alternatively, or additionally, the locking mechanism may be implemented to allow an unlocking when a predetermined force is exerted onto the wall. Embodiments may thus include the spring pretensioned locking mechanism which was described above which comprises a movable fixing or latching element which may be latched to a protrusion of the neighboring wall, wherein the protrusion and/or the latching element comprises contact surfaces which are inclined with respect to the vertical direction in the upfolded state such that the locking mechanism opens against its spring pretensioning when exceeding a predetermined force directed inwards and exerted upon the wall, as it is for example described in WO 2010/11907381 A1.

The above described embodiments only represent an illustration of the principles of the present invention. It is obvious that modifications and variations of the arrangements and details described herein are obvious to other persons skilled in the art. It is thus the purpose for the invention only to be limited by the protective scope of the following patent claims and not by the specific details which were presented herein with reference to the description and the explanation of the embodiments.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A box, comprising:

a floor; and at least two pairs of respectively opposing sidewalls extending upwards from the floor in a vertical direction, wherein the sidewalls are arranged foldably with respect to the floor and may be locked to each other in their upfolded position, wherein at least one of the sidewalls comprises an unlocking mechanism which is movable between a rest position and an unlocking position in which locking of the sidewalls is undone, wherein the unlocking mechanism comprises at least one pretensioning element pretensioning the unlocking mechanism into its rest position, the at least one pretensioning element comprising a first end that is connected to an unlocking bar of the unlocking mechanism, and the at least one pretensioning element comprising a second end that is free, wherein the at least one sidewall comprises an upper frame, wherein the movement of the unlocking mechanism from the rest position into the unlocking position comprises a movement into the direction of the upper frame, and wherein the free end of the pretensioning element is applied to a bottom side of the upper frame or, both in the rest position and also in the unlocking position of the unlocking mechanism, and wherein the upper frame comprises a protrusion extending downwards in an area in which the free end of the pretensioning element is applied to its bottom side, wherein the free end is arranged in the direction of the interior of the box behind the protrusion in a gap formed between the protrusion and the at least one sidewall, wherein a movement in a direction perpendicular to a wall surface of the sidewall is prevented;

wherein the at least one sidewall comprises a wall section whose thickness is smaller than the thickness of the upper frame and which extends downwards from the upper frame, wherein the free end of the pretensioning element is arranged between the protrusion and the wall section, wherein the pretensioning element comprises a first section integral with the unlocking bar, and a second section extending from the first section to the protrusion, the first and second sections having a thickness which corresponds to the thickness of the upper frame minus the thickness of the wall section so that, when the unlocking mechanism is installed, a front surface of the pretensioning element facing outward is flush with a front surface of the upper frame which is facing outward;

wherein the pretensioning element comprises a third section extending from the second section to the free end, the thickness of the third section is smaller than the thickness of the rest of the pretensioning element, and wherein the thickness of the third section corresponds to the thickness of the upper frame minus the thickness of the wall section and minus the thickness of the protrusion.

2. The box according to claim 1, wherein one sidewall comprises a first locking element which cooperates with a second locking element of a neighboring sidewall to lock the sidewall and the neighboring sidewall in the upfolded position, wherein the unlocking mechanism cooperates with the first unlocking element so that a movement of the unlocking mechanism in its unlocking position causes an unlocking of the first and second locking elements, and wherein the unlocking mechanism returns into its rest position without actuation due to the pretensioning element.

3. The box according to claim 1, wherein the pretensioning element is manufactured from the same material as the unlocking mechanism, wherein the pretensioning element comprises a first basically vertical portion arranged at the unlocking mechanism, a second inclined portion extending between the first section and the protrusion and a third section which is basically vertical in the rest position of the unlocking mechanism which extends from the second section to the free end of the pretensioning element.

4. The box according to claim 3, wherein the first end is formed integrally with the unlocking mechanism, and wherein the second end of the pretensioning element facing away in the unlocking mechanism is free and applied to a section of the sidewall in order to pretension the unlocking mechanism into its rest position.

5. The box according to claim 1, wherein the first end of the pretensioning element is formed integrally with the unlocking mechanism.

6. The box according to claim 1, wherein the pretensioning element exerts no pretension onto the unlocking mechanism in its rest position, and wherein the pretensioning element, with a movement of the unlocking mechanism from the rest position in the direction of the unlocking position, causes an increasing force in the direction of the rest position acting upon the unlocking mechanism.

7. The box according to claim 1, wherein the at least one sidewall comprises at least one guide opening in which a guiding element of the unlocking mechanism is arranged, wherein the guide opening defines a movement between the rest position and the unlocking position.

8. The box according to claim 1, wherein two opposing sidewalls each comprise an unlocking mechanism, wherein the unlocking mechanism comprises the unlocking bar extending in a transverse direction across the sidewalls between guide pins and two pretensioning elements arranged symmetrically with respect to the center of the corresponding sidewall.

* * * * *